US011167547B2

(12) United States Patent
Kato et al.

(10) Patent No.: US 11,167,547 B2
(45) Date of Patent: Nov. 9, 2021

(54) PRINTING APPARATUS, AND A DEVIATION AMOUNT CALCULATING METHOD THEREFOR

(71) Applicant: SCREEN HOLDINGS CO., LTD., Kyoto (JP)

(72) Inventors: Tomotaka Kato, Kyoto (JP); Keiji Hatano, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/524,957

(22) Filed: Jul. 29, 2019

(65) Prior Publication Data

US 2020/0086630 A1 Mar. 19, 2020

(30) Foreign Application Priority Data

Sep. 19, 2018 (JP) ..... JP2018-174951

(51) Int. Cl.
*B41J 2/045* (2006.01)
*B41J 2/21* (2006.01)
*B41J 29/393* (2006.01)

(52) U.S. Cl.
CPC ..... *B41J 2/04505* (2013.01); *B41J 2/2135* (2013.01); *B41J 2/2146* (2013.01); *B41J 29/393* (2013.01); *B41J 2029/3935* (2013.01)

(58) Field of Classification Search
CPC ..... B41J 2/2146; B41J 29/393; B41J 2/2135; B41J 2/04505; B41J 2029/3935
See application file for complete search history.

(56) References Cited

U.S. PATENT DOCUMENTS 7,213,900 B2 * 5/2007 Ebihara ..... B41J 29/393 347/19
10,532,559 B2 * 1/2020 Quintero Ruiz ..... B41J 2/2146
2015/0029256 A1 1/2015 Yamanaka et al.

FOREIGN PATENT DOCUMENTS

JP 2015-024613 A 2/2015

* cited by examiner

*Primary Examiner* — Geoffrey S Mruk

(74) *Attorney, Agent, or Firm* — McDermott Will & Emery LLP

(57) ABSTRACT

A printing apparatus for printing on a printing medium transported includes the following elements. A print head including a plurality of print head modules, a printing controller for controlling printing of a testing chart by selecting a reference print head module to provide a reference for recording positions, causing the reference print head module to print a reference chart, and causing one of the print head modules shifted relative to the reference print head module to print a comparison chart, a scanner for acquiring testing image data, an image processor for creating an extract reference chart, creating an extract comparison chart, and creating a composite testing chart by superimposing these charts, and a deviation amount calculator for calculating a deviation amount based on the composite testing chart.

8 Claims, 7 Drawing Sheets

REFERENCE CHART RC

COMPARISON CHART CC

COMPOSITE TESTING CHART cTC

COMPOSED BY MINIMUM VALUE

COMPOSITE TESTING CHART cTC

COMPOSED BY AVERAGE VALUE

PRINTING APPARATUS, AND A DEVIATION AMOUNT CALCULATING METHOD THEREFOR

BACKGROUND OF THE INVENTION

(1) Field of the Invention

This invention relates to a printing apparatus and a deviation amount calculating method for calculating an amount of deviation of a print position in a transport direction of a printing medium when printing on the printing medium.

(2) Description of the Related Art

Conventionally, a first known apparatus of this type includes one print head having a plurality of print head modules arranged in a width direction of web paper which is perpendicular to a transport direction of the web paper (see Japanese Unexamined Patent Publication No. 2015-24613, for example). In such first apparatus, the one print head may have the plurality of print head modules shifted in the transport direction with end regions thereof partly overlapping one another in the width direction of the web paper. The first apparatus constructed in this way may include a printing controller which operates the print head modules to print a testing chart for calculating deviation amounts, a scanner for scanning the testing chart, and a calculator for calculating deviation amounts of ink droplet dispensing positions of the respective print head modules based on the testing chart scanned by the scanner.

In the first apparatus, the printing controller controls printing of the testing chart as follows. First, ink droplets are dispensed from a portion of a print head module acting as reference, which portion overlaps a different adjacent print head module in the width direction, to print a reference chart having a plurality of line segments arranged at intervals in the transport direction of the web paper, with long axes extending in the width direction of the web paper. Next, a comparison chart is printed by a portion of the different print head module partly overlapping the reference print head module in the same position in the width direction of the web paper as the reference chart to overlap the reference chart in the transport direction, the comparison chart having a plurality of line segments arranged at intervals in the transport direction of the web paper, with long axes extending in the width direction of the web paper. With such testing chart, a positional relationship between the reference chart and the comparison chart shifts since there occurs a shift in print position when dispensation timing by the different print head module is shifted relative to the reference print head module. As a result, density peak positions of the testing chart become shifted, which enables the calculator to derive a deviation amount from results of scan by the scanner.

A second known apparatus of this type includes a plurality of print heads arranged at intervals in a transport direction of web paper, a printing controller which operates the print heads to print a testing chart for calculating a deviation amount, a scanner for scanning the testing chart, and a calculator for calculating deviation amounts of the respective print heads based on the testing chart scanned by the scanner (see International Publication WO2017/051796, for example).

In the second apparatus, the printing controller controls printing of the testing chart as follows. First, a print head acting as reference is operated to dispense ink droplets to print a reference chart having a plurality of line segments arranged at intervals in the transport direction of the web paper, with long axes extending in the width direction of the web paper. Next, a comparison chart is printed by a print head different from the reference print head in the same position in the width direction of the web paper as the reference chart to overlap the reference chart in the transport direction, the comparison chart having a plurality of line segments arranged at intervals in the transport direction of the web paper, with long axes extending in the width direction of the web paper. With such testing chart also, as in the first apparatus described above, shifting of dispensation timing causes a shift in density peak positions of the testing chart, which enables the calculator to derive a deviation amount.

SUMMARY OF THE INVENTION

However, the conventional examples with such constructions have the following problems.

The first conventional apparatus may not use, at the time of printing products, one of the portions overlapping each other in the width direction of the reference print head module and the different print head module. Therefore, with that portion used only at the time of printing the testing chart, the dispensation of ink droplets will become unstable. This will causes a problem that the testing chart including the comparison chart printed in the same position in the width direction of the web paper as the reference chart cannot be printed accurately.

The second conventional apparatus can cause the different print head to print the comparison chart in the same position in the width direction of the web paper as the reference chart. However, use of ultraviolet ray curing ink droplets will give rise to the following different problem, for example.

That is, in printing the testing chart, ink droplets are dispensed for the comparison chart to a plurality of line segments between the line segments of the reference chart printed at narrow intervals. Since the ultraviolet ray curing ink droplets do not cure before being irradiated with ultraviolet rays, the ink droplets of adjoining line segments are drawn toward each other by surface tension, and hence a problem that the intervals between the line segments cannot be printed accurately in the testing chart. In other words, the different print head can print the comparison chart in the same position in the width direction of the web paper as the reference chart, but when ultraviolet ray curing ink droplets are used, the testing chart thereby obtained does not allow a deviation amount to be calculated accurately.

This invention has been made having regard to the state of the art noted above, and its object is to provide a printing apparatus and a deviation amount calculating method capable of calculating a deviation amount from a reference chart and a comparison chart not overlapping each other in a width direction.

To fulfill the above object, this invention provides the following construction.

A printing apparatus for printing on a printing medium transported, according to this invention, comprises a print head including a plurality of print head modules arranged in a width direction perpendicular to a transport direction of the printing medium, the print head modules being shifted in the transport direction, with parts of end regions thereof overlapping one another in the width direction; a printing controller for controlling printing of a testing chart including a reference chart and a comparison chart, by selecting a reference print head module from the print head modules to provide a reference for recording positions of the print head modules, causing the reference print head module to print on the printing medium the reference chart including a plurality of line segments having a predetermined length in the width direction and arranged at intervals in the transport direction, and causing one of the print head modules shifted relative to the reference print head module to print, in a position on the printing medium not overlapping the reference chart in the width direction, the comparison chart including a plurality of line segments having a predetermined length in the width direction and arranged at intervals in the transport direction; a scanner for scanning the testing chart to acquire testing image data; an image processor for creating an extract reference chart by extracting the reference chart from the testing image data, creating an extract comparison chart by extracting the comparison chart from the testing image data, and creating a composite testing chart by superimposing the extract reference chart and the extract comparison chart in the width direction; and a deviation amount calculator for calculating a deviation amount from amounts of movement of density peak positions based on the extract reference chart and the extract comparison chart in the composite testing chart.

According to this invention, the printing controller has a testing chart printed by causing the print head module used as reference among the print head modules of the print head to print a reference chart, and causing the print head module different from the print head module used as the reference to print a comparison chart in a position not overlapping the reference chart in the width direction. The scanner scans the testing chart and acquires testing image data. The image processor creates an extract reference chart and an extract comparison chart from the testing image data, and creates a composite testing chart by superimposing the extract reference chart and extract comparison chart in the width direction. The deviation amount calculator calculates a deviation amount based on amounts of movement of density peak positions from the extract reference chart and extract comparison chart in the composite testing chart. Consequently, the deviation amount can be calculated based even on the reference chart and comparison chart not overlapping each other in the width direction.

In another aspect of this invention, a printing apparatus for printing on a printing medium transported, comprises a plurality of print heads arranged at intervals in a transport direction of the printing medium; a printing controller for controlling printing of a testing chart including a reference chart and a comparison chart, by selecting a reference print head from the print heads to provide a reference for recording positions of the print heads, causing the reference print head to print on the printing medium the reference chart including a plurality of line segments having a predetermined length in the width direction and arranged at intervals in the transport direction, and causing one of the print heads spaced in the transport direction from the reference print head to print, in a position on the printing medium not overlapping the reference chart in the width direction, the comparison chart including a plurality of line segments having a predetermined length in the width direction and arranged at intervals in the transport direction; a scanner for scanning the testing chart to acquire testing image data; an image processor for creating an extract reference chart by extracting the reference chart from the testing image data, creating an extract comparison chart by extracting the comparison chart from the testing image data, and creating a composite testing chart by superimposing the extract reference chart and the extract comparison chart in the width direction; and a deviation amount calculator for calculating a deviation amount from amounts of movement of density peak positions based on the extract reference chart and the extract comparison chart in the composite testing chart.

According to this invention, the printing controller has a testing chart printed by causing the print head used as reference among the plurality of print heads to print a reference chart, and causing the print head different from the print head used as the reference to print a comparison chart in a position not overlapping the reference chart in the width direction. The scanner scans the testing chart and acquires testing image data. The image processor creates an extract reference chart and an extract comparison chart from the testing image data, and creates a composite testing chart by superimposing the extract reference chart and extract comparison chart in the width direction. The deviation amount calculator calculates a deviation amount based on amounts of movement of density peak positions from the extract reference chart and extract comparison chart in the composite testing chart. Consequently, even when ultraviolet ray curing ink droplets are used, the deviation amount can be calculated by using the reference chart and comparison chart not overlapping each other in the width direction.

In this invention, it is preferred that the printing controller is configured to set a difference between the length in the width direction of the line segments of the reference chart and the length in the width direction of the line segments of the comparison chart.

The printing controller causes the line segments of the reference chart and comparison chart to be different in length in the width direction. This facilitates identification by the image processor of the respective charts in the composite testing chart.

In this invention, it is preferred that the image processor is configured to create the composite testing chart by clipping a large frame area including the reference chart and the comparison chart from the testing image data, clipping the extract reference chart and the extract comparison chart from the large frame area, clipping the extract reference chart and the extract comparison chart separately, and combining the separate extract reference chart and the separate extract comparison chart.

The image processor clips a large frame area, and separately clips the extract reference chart and extract comparison chart out of this large frame area. Thus, the charts can be extracted efficiently. Further, the composite testing chart is created by combining the extract reference chart and extract comparison chart clipped separately, whereby the composite testing chart can be created efficiently.

In this invention, it is preferred that the image processor is configured, when combining the extract reference chart and the extract comparison chart, to compare pixel values of these charts, and replace the pixel values with smaller pixel values.

When combining the extract reference chart and the extract comparison chart, the image processor compares pixel values of these charts, and replaces the pixel values with smaller pixel values (closer to black). Since this can largely maintain intact the ranges of the two charts in the range of pixel values of the composite testing chart, density peaks of the pixel values can easily be found in the composite testing chart.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Preferred embodiments of this invention will be described in detail hereinafter with reference to the drawings.

Embodiment 1

Embodiment 1 will be described hereinafter with reference to the drawings.

Figure 1:
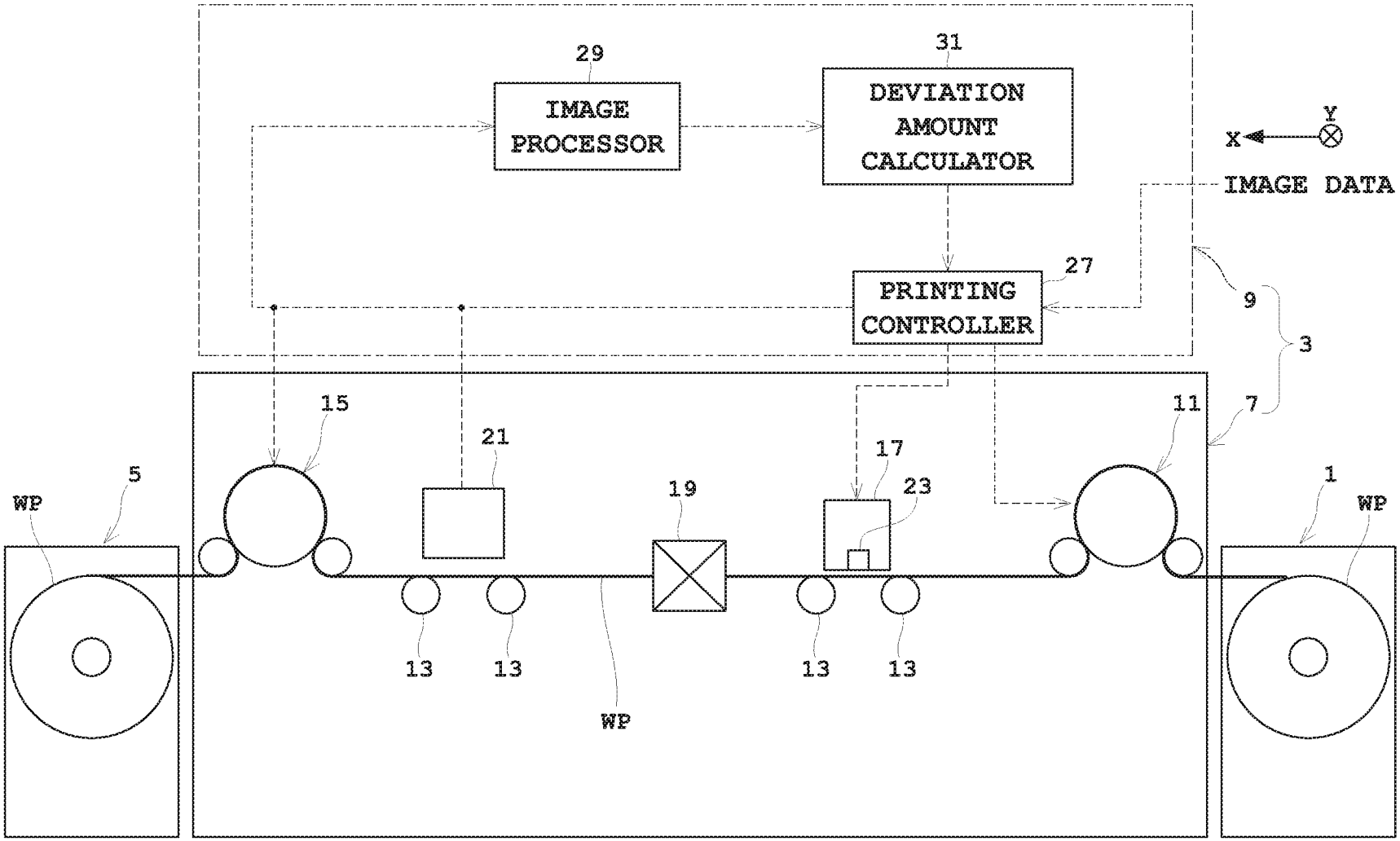
FIG. 1 is an outline view showing an entire inkjet printing system according to Embodiment 1.
Figure 2:
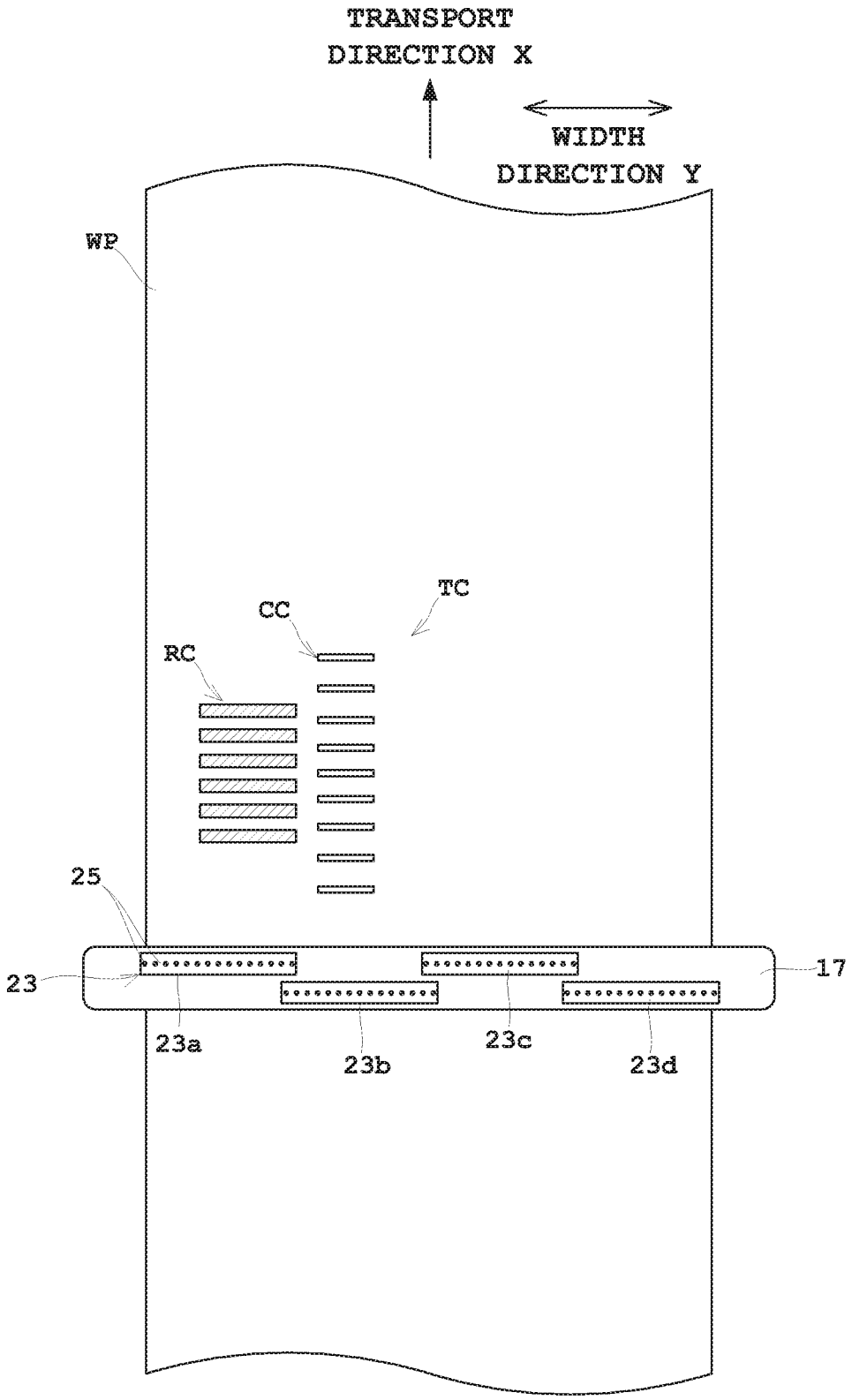
FIG. 2 is a schematic view showing a positional relationship in plan view between web paper, a print head, and each print head module.

FIG. 1 is an outline schematic view showing an entire construction of an inkjet printing system according to Embodiment 1. FIG. 2 is a schematic view showing a positional relationship in plan view between web paper, a print head, and each print head module.

The inkjet printing system according to this embodiment includes a paper feeder 1, an inkjet printing apparatus 3, and a takeup roller 5.

The paper feeder 1 holds a roll of web paper WP to be rotatable about a horizontal axis, and unwinds the web paper WP in a transport direction X to feed it to the inkjet printing apparatus 3. The inkjet printing apparatus 3 carries out printing on the web paper WP. The takeup roller 5 winds up the web paper WP printed in the inkjet printing apparatus 3 into a roll form around a horizontal axis. Regarding the supply side of web paper WP as upstream and the discharge side of web paper WP as downstream, the paper feeder 1 is located upstream of the inkjet printing apparatus 3, and the takeup roller 5 downstream of the inkjet printing apparatus 3.

The inkjet printing apparatus 3 includes a main body 7 and a printing control unit 9. The main body 7 has a drive roller 11 located in an upstream position for taking in the web paper WP from the paper feeder 1. The web paper WP unwound in the transport direction X from the paper feeder 1 by the drive roller 7 is transported along a plurality of transport rollers 13 downstream toward the takeup roller 5. A drive roller 15 is located between the most downstream transport roller 13 and the takeup roller 5. This drive roller 15 feeds the web paper WP transported on the transport rollers 13 toward the takeup roller 5.

The main body 7 of the inkjet printing apparatus 3 has, between the drive roller 11 and drive roller 15, a print head 17, a drying unit 19, and a scanner 17 arranged in the stated order from upstream.

The print head 17 has a plurality of print head modules 23 for dispensing ink droplets. This embodiment will be described taking for example four print head modules 23 arranged in a width direction Y perpendicular to the transport direction X of web paper WP as shown in FIG. 2. In the following description, the print head modules 23 will be called print head modules 23*a*-23*d* when they need to be distinguished, but will be called simply print head modules 23 when they are not distinguished. Each print head module 23 has a plurality of nozzles 25 formed in a lower surface thereof opposed to the web paper WP for dispensing ink droplets. For expediency of illustration, the nozzles 25 appear in FIG. 2 to be formed on upper surfaces of the print head modules 23, but actually they are formed on the lower surfaces.

On the downstream side in the transport direction X of the web paper WP directed upward in plan view as shown in FIG. 2, the four print head modules 23*a*-23*d* are arranged in order from left in the width direction Y of the web paper WP. The print head modules 23*a* and 23*c* are located in the same position in the transport direction X of the web paper WP, and the print head modules 23*b* and 23*d* are shifted in the transport direction X of the web paper WP from the print head modules 23*a* and 23*c*. Specifically, the print head modules 23*b* and 23*d* are arranged in the same position upstream of the print head modules 23*a* and 23*c* with respect to the transport direction X of the web paper WP. In addition, the four print head modules 23*a*-23*d* are arranged to have parts of end regions thereof overlapping one another in the width direction Y of the web paper WP. In other words, the four print head modules 23*a*-23*d* are attached in a zigzag arrangement to the print head 17.

It is common practice to provide a plurality of print heads 17 arranged along the transport direction X of the web paper WP. For example, four print heads 17 are provided separately for black (K), cyan (C), magenta (M), and yellow (Y). However, in order to facilitate understanding of the invention, the following description will be made taking for example the case of providing only one print head 17.

The drying unit 19 dries a printed surface of the web paper WP having images printed by the dispensed ink droplets thereto. The drying unit 19 has a heat drum (also called heat roller) not shown. The heat drum is put in contact with a non-printed surface of the web paper WP to dry the ink droplets deposited on the printed surface of the web paper WP.

The scanner 21 scans the printed surface of the web paper WP to check for any stains, omissions or other defects on the printed surface, and scans a testing chart including a reference chart and a comparison chart to determine a deviation amount which will be described hereinafter. This scanner 21 has an image pickup device and an optical system, for example, to scan the web paper WP transported under the scanner 21, and acquire and output testing image data as described hereinafter.

The printing control unit 9 performs overall control of printing in the main body 7 of the inkjet printing apparatus 3. Specifically, the printing control unit 9 receives print data corresponding to images to be printed, from an external computer or the like, and carries out control of the main body 7 according to the print data received. In response to output of the scanner 21, the printing control unit 9 reports test results to the operator of this apparatus, and depending on the test results, may temporarily stop operation of the main body 7 of the inkjet printing apparatus 3. Further, the printing control unit 9 calculates a deviation amount in the transport direction X between the print head modules 23 from the testing chart described hereinafter, and adjusts timing of inking from each print head module 23 based on the deviation amount.

A printing controller 27 controls each component engaged in the printing as noted above, adjusts timing of inking from each print head module 23 in response to the calculated deviation amount, and performs printing in a way to cause no shifting in the transport direction X of the print head modules 23 with regard to the dots which should be printed in the same position in the transport direction X. The printing controller 27 controls printing of the testing chart for calculating the deviation amount as follows.

In this example, as shown in FIG. 2, the print head module 23*a* is used as recording position reference, and this print head module 23*a* is made to print a reference chart RC. Further, a comparison chart CC is printed by the print head module 23*b* which is shifted in the transport direction X from and located adjacent the print head module 23*a*. The testing chart TC including the reference chart RC and comparison chart CC is printed in this way.

The above print head module 23*a* corresponds to the "reference print head module" in this invention.

The reference chart RC is formed of a plurality of line segments having a first length in the width direction Y of the web paper WP within a range not exceeding a length in the width direction Y of each print head module 23, and arranged at intervals in the transport direction X. FIG. 2 shows six such line segments as an example. All the intervals in the transport direction X between the line segments constituting the reference chart RC are the same.

The comparison chart CC is formed of a plurality of line segments having a second length in the width direction Y of the web paper WP, and arranged at intervals in the transport direction X. The comparison chart CC is printed in a position relative to the reference chart RC not to overlap the line segments of the reference chart RC in the width direction Y. In this embodiment, the reference chart RC and comparison chart CC are printed to have their respective ends spaced from each other in the width direction Y. In particular, the comparison chart CC has a middle line segment in the transport direction X which is located at the middle between middle line segments of the reference chart RC, and has an even number of line segments on each of an upstream side and a downstream side separated in the line width direction X across the middle line segment of the comparison chart CC. These line segments are arranged at intervals becoming progressively larger away upstream and downstream from the middle line segment.

The comparison chart CC has a larger number of line segments than the reference chart RC, but conversely, the reference chart RC may have a larger number of line segments than the comparison chart CC. The first length of the line segments of the reference chart RC is set larger than the second length of the line segments of the comparison chart CC. This facilitates a distinction between the reference chart RC and comparison chart CC in a composite chart described hereinafter. The relationship between the first length in the reference chart RC and the second length in the comparison chart CC may be reversed.

An image processor 29 processes the testing image data corresponding to the testing chart TC including the reference chart RC and comparison chart CC scanned and acquired by the scanner 21. As will be described in detail hereinafter, and briefly now, the image processor 29 creates an extract reference chart by extracting the reference chart RC from the testing image data, and creates an extract comparison chart by extracting the comparison chart CC from the testing image data. Then, the image processor 29 creates a composite testing chart by superimposing the extract reference chart and extract comparison chart in the width direction Y.

A deviation amount calculator 31 calculates the deviation amount based on amounts of movement of density peak positions from the extract reference chart and extract comparison chart in the composite testing chart. Details of the testing chart TC including the reference chart RC and comparison chart CC noted above and the calculation of the deviation amount using these charts are disclosed in Japanese Patent No. 6282912 in the name of Applicant herein.

Figure 3:
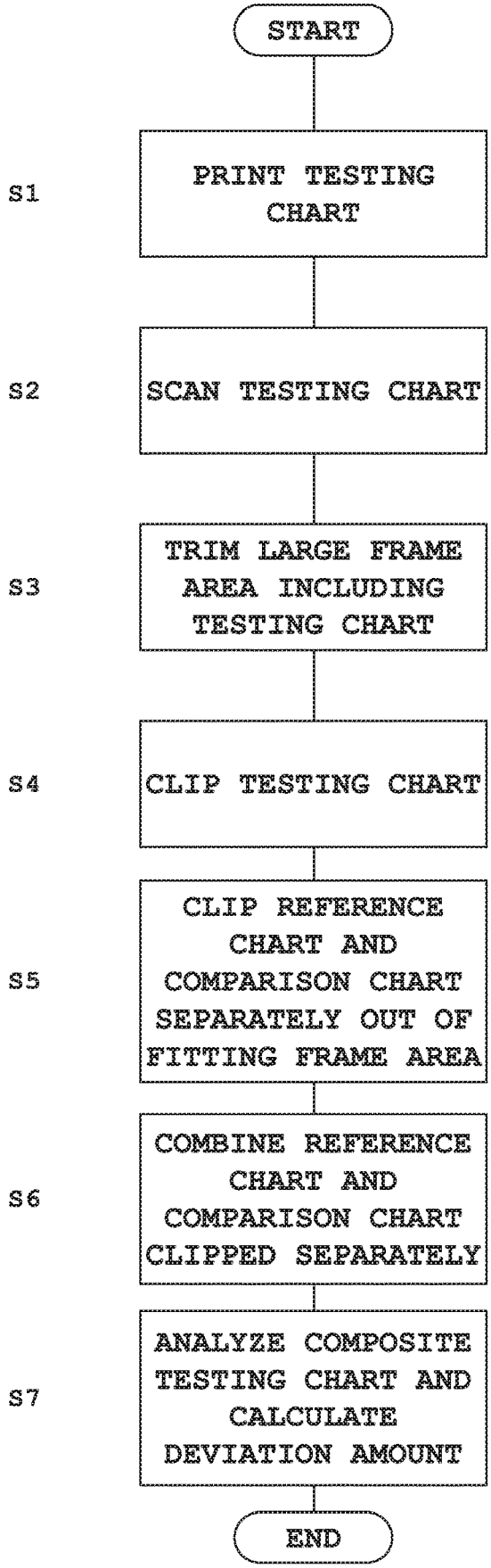
FIG. 3 is a flow chart showing a flow of a deviation amount calculating process.

Next, details of a deviation amount calculating process will be described with reference to FIGS. 3 and 4. FIG. 3 is a flow chart showing a flow of the deviation amount calculating process. FIGS. 4A-4D are schematic views showing a flow of a process for composing the testing chart.

Step S1 (Testing Chart Printing Process)

The printing control unit 9, with the printing controller 27 controlling the components, prints the testing chart TC on the web paper WP as shown in FIG. 2. The testing chart TC includes the reference chart RC printed by the first print head module 23*a*, and the comparison chart CC printed by the second print head module 23*b*. Each line segment of the reference chart RC has a higher density than each line segment of the comparison chart CC.

Step S2 (Scanning Process)

Figure 4A:
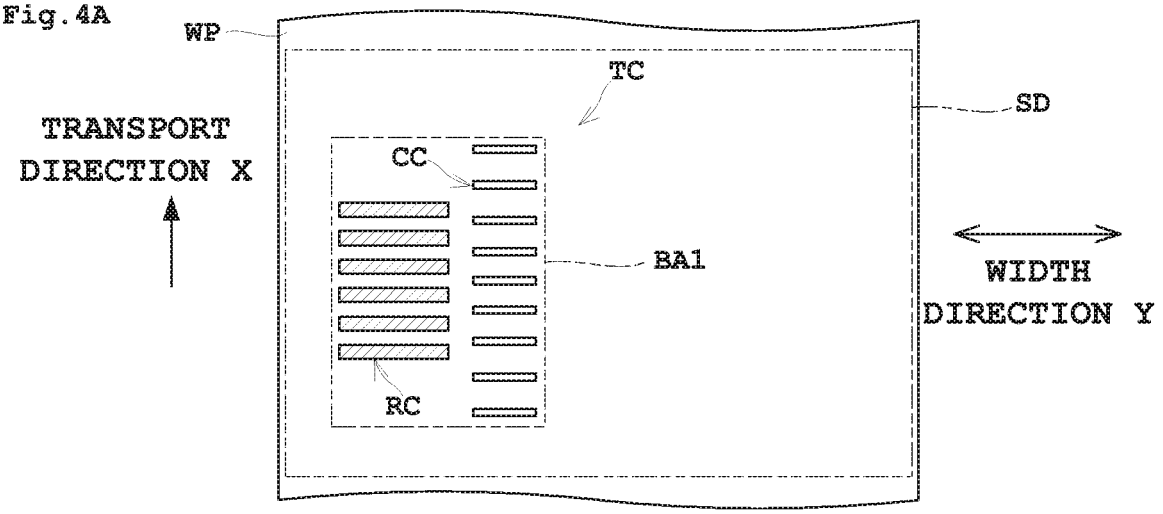
FIGS. 4A-4D are schematic views showing a flow of a process for composing testing charts.
Figure 4B:
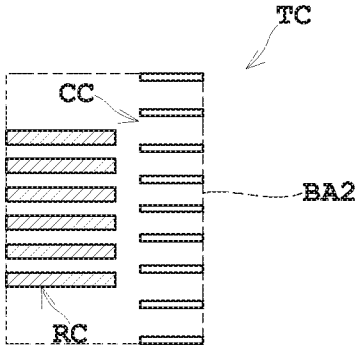
Figure 4C:
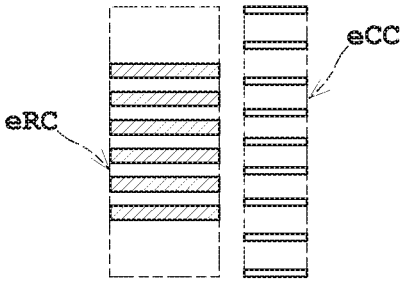

The printing control unit 9, with the scanner 21, scans the testing chart TC printed on the web paper WP. Data thereby obtained is outputted as testing image data to the image processor 29. Specifically, as shown in FIG. 4A, for example, the web paper WP has an area including the testing chart TC set as scan area SD, and data of the scan area SD is outputted as the testing image data to the image processor 29.

Step S3

The printing control unit 9, with the image processor 29, cuts the testing chart TC in the shape of a somewhat large rectangle from the testing image data, and clips a broad frame area roughly including the testing chart TC. This is shown as large frame area BA1 in FIG. 4A.

Step S4

The image processor 29 clips the testing chart TC out of the large frame area BA1. Specifically, the image processor 29 compares pixel values in the transport direction X and width direction Y of the large frame area BA1 with a threshold, and determines locations of the reference chart RC and comparison chart CC in the large frame area BA1. Then, the image processor 29 clips a rectangle in a size that can enclose the testing chart TC within the large frame area BA1. This is shown as fitting frame area BA2 in FIG. 4B.

Step S5

The image processor 29 clips the reference chart RC and comparison chart CC separately out of the fitting frame area BA2. Specifically, for example, the plurality of nozzles 25 used to print the reference chart RC and comparison chart CC are known beforehand, and so the reference chart RC and comparison chart CC are clipped in the width direction Y based on a size in the width direction Y corresponding to the number of nozzles 25. This allows an extract reference chart eRC corresponding to the reference chart RC to be extracted from the fitting frame area BA2, and an extract comparison chart eCC corresponding to the comparison chart CC to be extracted (see FIG. 4C).

Step S6 (Chart Creating Process)

Figure 4D:
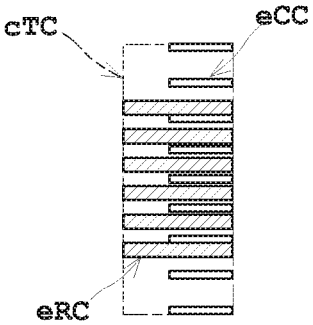

The image processor 29 combines the extract reference chart eRC and extract comparison chart eCC clipped separately, to create a composite testing chart cTC (see FIG. 4D). Specifically, the image processor 29 scans pixel values of pixels of the larger in the width direction Y of the extract reference chart eRC and extract comparison chart eCC, and when there exists a pixel value of the other chart in the same position as a pixel scanned, selects the smaller pixel value as a new pixel value for that same position. Consequently, the composite testing chart cTC shown in FIG. 4D is created from the extract reference chart eRC and extract comparison chart eCC.

Step S7 (Deviation Amount Calculating Process)

The deviation amount calculator 31 of the printing control unit 9 calculates the deviation amount from the composite testing chart cTC. Specifically, the deviation amount calculator 31 calculates the deviation amount from distances between density peak positions obtained from the composite testing chart cTC and density peak positions obtained beforehand and reflecting no deviation. The deviation amount obtained in this way is given to the printing controller 27 to be set as deviation amount of the print head module 23*b* relative to the print head module 23*a*, and used in adjustment of the dispensing timing of ink droplets. For the other print head modules 23*b* and 23*c* and print head modules 23*c* and 23*d*, deviation amounts can be calculated similarly by creating the composite testing chart cTC after printing similar testing charts TC.

The creation of the composite testing chart cTC will now be described in detail with reference to FIG. 5. FIGS. 5A-5D are schematic views showing pixel values of each chart.

Figure 5A:
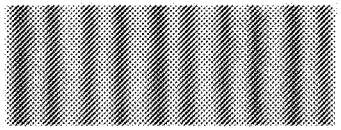
FIGS. 5A-5D are schematic views showing pixel values of each chart.
Figure 5B:
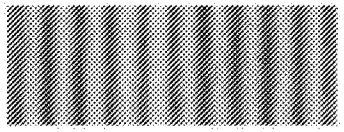
Figure 5C:
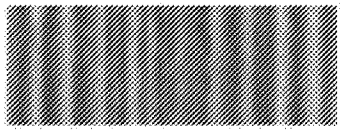

In the process of step S6, the image processor 29 creates the composite testing chart cTC. At this time, the image processor 29 scans pixel values of the larger one in the width direction Y of the extract reference chart eRC and extract comparison chart eCC, and selects the smaller pixel values (the higher density (or blacker)) in the same positions of the two charts as new values. Assume, for example, that the extract reference chart eRC is a reference chart RC and that the extract comparison chart eCC is a comparison chart CC, this technique can obtain a composite testing chart cTC (FIG. 5C) from a range of pixel values in a certain reference chart RC (FIG. 5A) and a range of pixel values in a certain comparison chart CC (FIG. 5B). Since this can largely maintain intact the ranges of the two charts RC and CC in the range of pixel values of the composite testing chart cTC, density peaks of the pixel values can easily be found in the composite testing chart cTC.

Figure 5D:
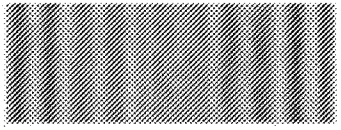

On the other hand, there is a technique different from the above which, for example, scans the pixel values, and selects an average value of the pixel values in the same position as a new value. This technique provides a composite testing chart cTC as shown in FIG. 5D. It will be seen there that the range of pixel values (corresponding to the length of a vertical axis represented by an up-down arrow) is narrow compared with that in FIG. 5C. From this point of view, it is preferable to use average values in step S6 noted above. When there is a possibility of noise mixing in, its influence can be inhibited by averaging. In such a case, it is preferable to use average values.

According to this embodiment, the printing controller 27 has a testing chart TC printed by causing the print head module 23*a* used as reference among the print head modules 23 of the print head 17 to print a reference chart RC, and causing the print head module 23*b* different from the print head module 23*a* used as the reference to print a comparison chart CC in a position not overlapping the reference chart RC in the width direction Y. The scanner 21 scans the testing chart TC and acquires testing image data. The image processor 29 creates an extract reference chart eRC and an extract comparison chart eCC from the testing image data, and creates a composite testing chart cTC by superimposing the extract reference chart eRC and extract comparison chart eCC in the width direction Y. The deviation amount calculator 31 calculates a deviation amount based on amounts of movement of density peak positions from the extract reference chart eRC and the extract comparison chart eCC in the composite testing chart cTC. Consequently, the deviation amount can be calculated based even on the reference chart RC and comparison chart CC not overlapping each other in the width direction Y.

The printing controller 27 causes the line segments of the reference chart RC and comparison chart CC to be different in length in the width direction Y. This facilitates identification by the image processor 29 of the charts RC and CC in the composite testing chart cTC.

Further, the image processor 29 clips the large frame area BA1, and separately clips the extract reference chart eRC and extract comparison chart eCC out of this large frame area BA1. Thus, the charts can be extracted efficiently, compared with clipping the charts out of the entire scan area SD. Further, the composite testing chart cTC is created by combining the extract reference chart eRC and extract comparison chart eCC clipped separately, whereby the composite testing chart cTC can be created efficiently.

In Embodiment 1 described above, the reference chart RC is printed by the print head module 23*a* acting as reference print head module, and the comparison chart CC is printed by the print head module 23*b*. Comparison charts CC may be printed by the other print head modules 23*c* and 23*d* to obtain deviation amounts of these modules at the same time. Further, the reference print head module may be selected from any one of the print head modules 23*b*-23*d* other than the print head module 23*a*.

Embodiment 2

Figure 6:
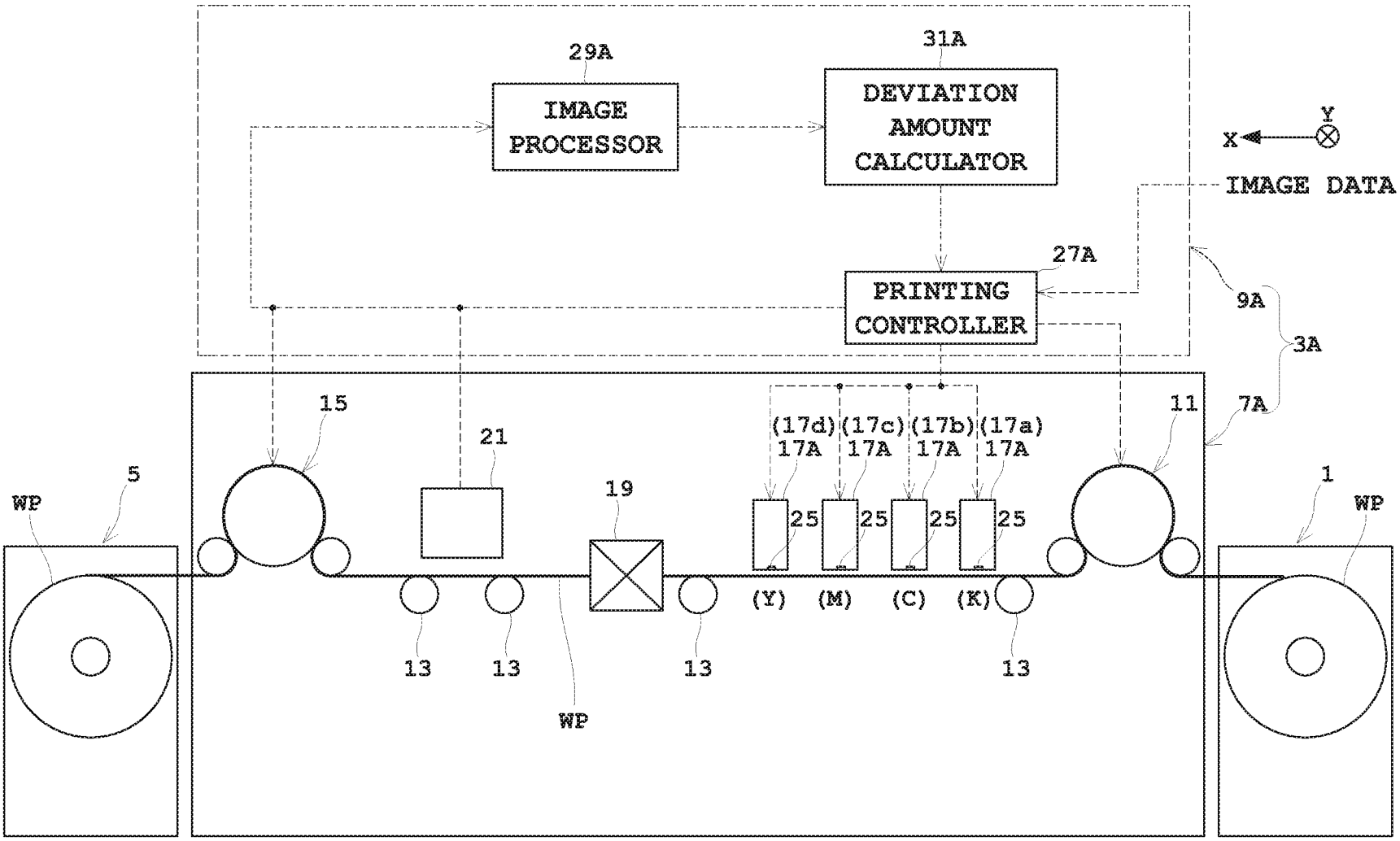
FIG. 6 is an outline view showing an entire inkjet printing system according to Embodiment 2.
Figure 7:
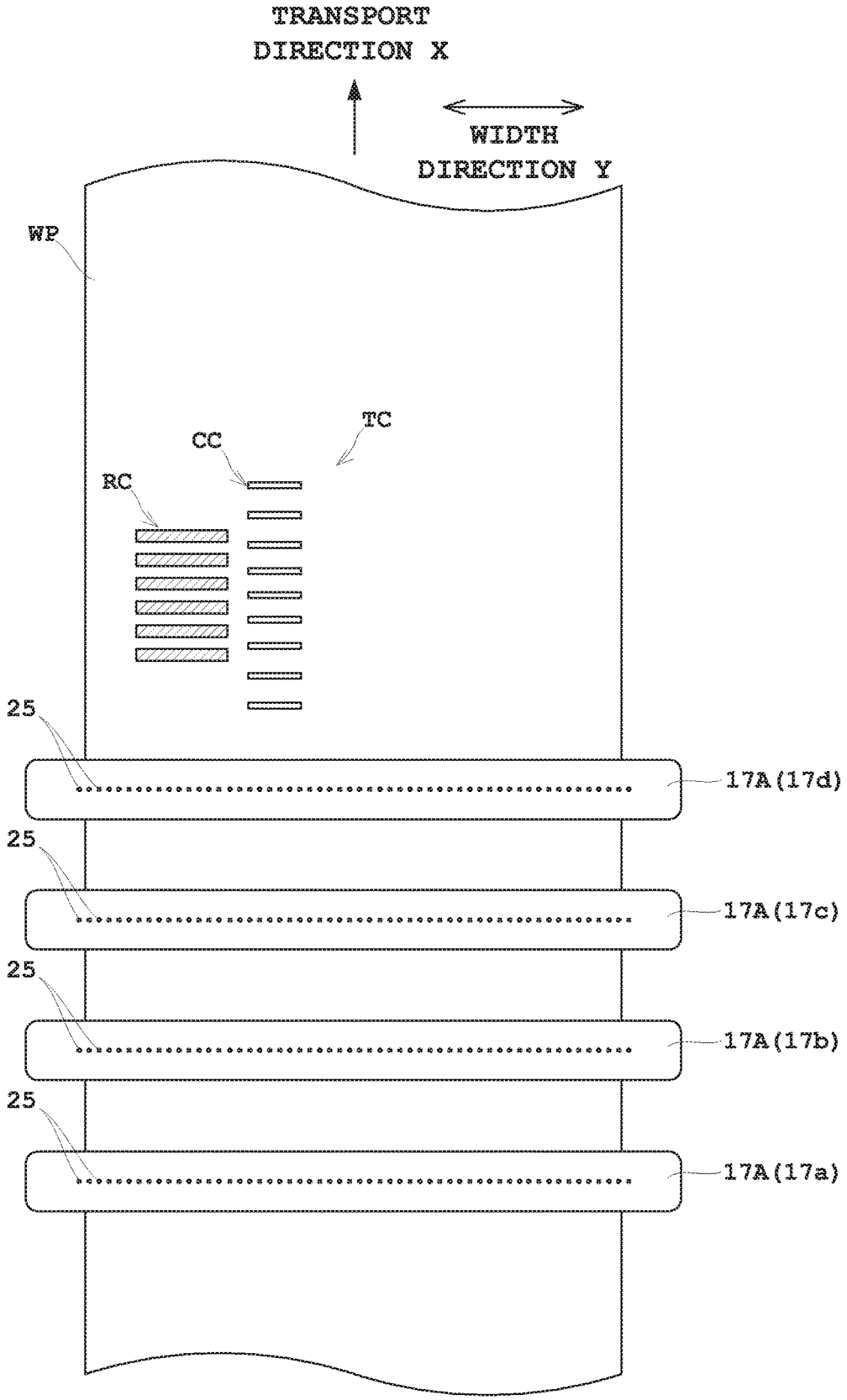
FIG. 7 is a schematic view showing a positional relationship in plan view between web paper and each print head.

Next, Embodiment 2 of this invention will be described with reference to the drawings. FIG. 6 is an outline view showing an entire inkjet printing system according to Embodiment 2. FIG. 7 is a schematic view showing a positional relationship in plan view between web paper and each print head. Components substantially the same as those of foregoing Embodiment 1 are shown with the same signs, and will not particularly be described.

The inkjet printing system according to this embodiment includes a different inkjet printing apparatus 3A. The most different is a main body 7A. The main body 7A has four print heads 17A arranged at intervals along the transport direction X. For example, the print heads 17A, in order from upstream, are for black (K), cyan (C), magenta (M), and yellow (Y). Here, the print heads 17A will be called print head 17*a*, print head 17*b*, print head 17*c*, and print head 17*d* in order from upstream when they need to be distinguished, but will be called simply print heads 17A when they are not distinguished. Each print head 17A has a plurality of nozzles 25 formed linearly in the width direction Y perpendicular to the transport direction X of web paper WP in plan view.

In the inkjet printing system having such construction, a printing controller 27A causes the print heads 17A to print a testing chart TC as shown in FIG. 7. For example, a reference chart RC is printed using part of the nozzles 25 included in the print head 17*a* located most upstream as reference print head, and a comparison chart CC is printed using part of the nozzles 25 included in the print head 17*b* located immediately downstream of the print head 17*a*. At this time, as in Embodiment 1 described hereinbefore, the reference chart RC and comparison chart CC are arranged apart without overlapping each other in the width direction Y.

Subsequently, the scanner 21 scans the testing chart TC. An image processor 29A creates an extract reference chart eRC and an extract comparison chart eCC as in foregoing Embodiment 1. Then, the image processor 29A creates a composite testing chart cTC. A deviation amount calculator 31A calculates a deviation amount between the print head 17*a* and print head 17*b* based on the composite testing chart cTC.

The above print head 17*a* corresponds to the "reference print head" in this invention.

According to this embodiment, the printing controller 27A has a testing chart TC printed by causing the print head 17*a* used as reference among the four print heads 17*a*-17*d* to print a reference chart RC, and causing the print head 17*b* different from the print head 17*a* used as the reference to print a comparison chart CC in a position not overlapping the reference chart RC in the width direction Y. The scanner 21 scans the testing chart TC and acquires testing image data. The image processor 29A creates an extract reference chart eRC and an extract comparison chart eCC from the testing image data, and creates a composite testing chart eTC by superimposing the extract reference chart eRC and extract comparison chart eCC in the width direction Y. The deviation amount calculator 31A calculates a deviation amounts based on amounts of movement of density peak positions from the extract reference chart eRC and extract comparison chart eCC in the composite testing chart cTC. Consequently, even when ultraviolet ray curing ink droplets are used, the use of the reference chart RC and comparison chart CC not overlapping each other in the width direction Y can prevent line spacing in the testing chart TC from becoming inaccurate due to the ultraviolet ray curing ink droplets drawn to ink droplets constituting the adjoining lines. As a result, the deviation amount can be calculated even when ultraviolet ray curing ink droplets are used.

In Embodiment 2 described above, the reference chart RC is printed by the print head 17*a* acting as reference print head, and the comparison chart CC is printed by the print head 17*b*. However, comparison charts CC may be printed also by the other print heads 17*c* and 17*d* to obtain deviation amounts relative to the reference print head 17*a* at the same time. Further, the reference print head may be selected from the print heads other than the print head 17*a*.

This invention is not limited to the foregoing embodiments, but may be modified as follows:

(1) Each of foregoing Embodiments 1 and 2 has been described taking for example the web paper WP as a printing medium, but this invention is not limited to such printing medium. For example, instead of the web paper WP, the printing medium may be cut sheet paper which is not long. Instead of paper, plastic may be used.

(2) The foregoing embodiments have been described taking for example the inkjet printing mode which dispenses ink droplets, but this invention is not limited to such printing mode.

(3) In the foregoing embodiments, the comparison chart CC has a middle line segment which is located at the middle between middle line segments of the reference chart RC, and has an even number of line segments on each of an upstream side and a downstream side separated in the line width direction X across the middle line segment of the comparison chart CC. This invention is not limited to such construction. That is, the comparison chart CC may have its middle line segment located at the middle of a middle line segment of the reference chart RC, with an even number of line segments on each of the upstream side and downstream side separated in the line width direction X across its middle line segment. In the examples in foregoing Embodiments 1 and 2, the density peaks which move according to the deviation amount are dark portions. According to this modification, the moving density peaks are light portions.

This invention may be embodied in other specific forms without departing from the spirit or essential attributes thereof and, accordingly, reference should be made to the appended claims, rather than to the foregoing specification, as indicating the scope of the invention.

What is claimed is:

1. A printing apparatus for printing on a printing medium transported, comprising:

a print head including a plurality of print head modules arranged in a width direction perpendicular to a transport direction of the printing medium, the print head modules being shifted in the transport direction, with parts of end regions thereof overlapping one another in the width direction;

a printing controller configured to control printing of a testing chart including a reference chart and a comparison chart, by selecting a reference print head module from the print head modules to provide a reference for recording positions of the print head modules, causing the reference print head module to print on the printing medium the reference chart including a plurality of line segments having a predetermined length in the width direction and arranged at intervals in the transport direction, and causing one of the print head modules shifted relative to the reference print head module to print, in a position on the printing medium not overlapping the reference chart in the width direction, the comparison chart including a plurality of line segments having a predetermined length in the width direction and arranged at intervals in the transport direction;

a scanner configured to scan the testing chart to acquire testing image data;

an image processor configured to create an extract reference chart by extracting the reference chart from the testing image data, creating an extract comparison chart by extracting the comparison chart from the testing image data, and creating a composite testing chart by superimposing the extract reference chart and the extract comparison chart in the width direction; and a deviation amount calculator configured to calculate a deviation amount from amounts of movement of density peak positions based on the extract reference chart and the extract comparison chart in the composite testing chart.

2. The printing apparatus according to claim 1, wherein the printing controller is configured to set a difference between the length in the width direction of the line segments of the reference chart and the length in the width direction of the line segments of the comparison chart.

3. The printing apparatus according to claim 2, wherein the image processor is configured to create the composite testing chart by clipping a large frame area including the reference chart and the comparison chart from the testing image data, clipping the extract reference chart and the extract comparison chart from the large frame area, clipping the extract reference chart and the extract comparison chart separately, and combining the separate extract reference chart and the separate extract comparison chart.

4. The printing apparatus according to claim 3, wherein the image processor is configured, when combining the extract reference chart and the extract comparison chart, to compare pixel values of these charts, and replace the pixel values with smaller pixel values.

5. The printing apparatus according to claim 2, wherein the print head is configured to dispense ink droplets.

6. The printing apparatus according to claim 1, wherein the image processor is configured to create the composite testing chart by clipping a large frame area including the reference chart and the comparison chart from the testing image data, clipping the extract reference chart and the extract comparison chart from the large frame area, clipping the extract reference chart and the extract comparison chart separately, and combining the separate extract reference chart and the separate extract comparison chart.

7. The printing apparatus according to claim 6, wherein the image processor is configured, when combining the extract reference chart and the extract comparison chart, to compare pixel values of these charts, and replace the pixel values with smaller pixel values.

8. The printing apparatus according to claim 1, wherein the print head is configured to dispense ink droplets.

* * * * *